US007159693B2

(12) United States Patent
Mettler

(10) Patent No.: US 7,159,693 B2
(45) Date of Patent: Jan. 9, 2007

(54) WINDOW SHUTTER ESCAPE LADDER

(76) Inventor: Mark D. Mettler, 393 N. Pioneer Ave., Dallas, PA (US) 18612

( * ) Notice: Subject to any disclaimer, the term of this patent is extended or adjusted under 35 U.S.C. 154(b) by 0 days.

(21) Appl. No.: 10/919,977

(22) Filed: Aug. 17, 2004

(65) Prior Publication Data

US 2006/0054389 A1 Mar. 16, 2006

(51) Int. Cl.
*E06C 9/00* (2006.01)
*E06C 1/00* (2006.01)

(52) U.S. Cl. ..... 182/77; 182/70; 182/195

(58) Field of Classification Search ..... 182/77, 182/70, 76, 195, 196; 49/74.1, 92.1; 52/473
See application file for complete search history.

(56) References Cited

U.S. PATENT DOCUMENTS

| | | | | | |
|---|---|---|---|---|---|
| 2,709,030 | A | * | 5/1955 | Vroman et al. | 182/76 |
| 3,692,145 | A | * | 9/1972 | Banner | 182/70 |
| 3,809,181 | A | * | 5/1974 | Staranick et al. | 182/70 |
| 3,946,833 | A | | 3/1976 | Riehlmann | |
| 4,079,811 | A | * | 3/1978 | Driskell | 182/70 |
| 4,127,184 | A | * | 11/1978 | Strohmeyer | 182/70 |
| 4,445,589 | A | * | 5/1984 | Longenecker | 182/76 |
| 4,702,347 | A | | 10/1987 | Nilson | |
| 4,805,736 | A | | 2/1989 | Byrnes, Jr. | |
| 4,852,688 | A | * | 8/1989 | Strohmeyer, Sr. | 182/70 |
| 4,919,235 | A | * | 4/1990 | DelSavio | 182/77 |
| 5,018,600 | A | * | 5/1991 | Sobczak | 182/70 |
| 5,339,920 | A | | 8/1994 | Eriksson | |
| 5,372,217 | A | * | 12/1994 | Hsu | 182/70 |
| 5,467,841 | A | * | 11/1995 | Krumal | 182/70 |
| 5,967,257 | A | | 10/1999 | Begin et al. | |
| 5,971,105 | A | * | 10/1999 | Jacobson | 182/70 |
| 6,015,027 | A | * | 1/2000 | Banks | 182/70 |
| 6,102,155 | A | * | 8/2000 | Hood et al. | 182/76 |
| 6,129,178 | A | * | 10/2000 | Shupp, Jr. | 182/76 |
| 6,135,239 | A | * | 10/2000 | Martin et al. | 182/70 |
| 6,382,352 | B1 | * | 5/2002 | Dowe, Sr. | 182/70 |
| 6,771,181 | B1 | * | 8/2004 | Hughen, Jr. | 182/76 |
| 6,845,844 | B1 | * | 1/2005 | Williams | 182/70 |
| 6,854,562 | B1 | * | 2/2005 | Kwak | 182/196 |

* cited by examiner

*Primary Examiner*—Hugh B. Thompson, II
(74) *Attorney, Agent, or Firm*—L. Zale Patent Law Office

(57) ABSTRACT

A novel escape system comprised of a plurality of escape devices each which resemble a window shutter, are mounted on the outside of a building, adjacent the windows vertically above the next lower escape device. Since these take up no space inside of the building, and are aesthetically pleasing, they are less likely to be removed or overridden making them functional a greater percentage of the time. Each is comprised of a frame to hold a plurality of slats connected to a collapsible vertical connecting means a predetermined distance apart from the others. In its storage position, the slats are held in the frame in an angled position resembling louvers. When in the operational position, the slats are allowed to drop down out of the frame and extend down to the next lower escape device with the slats acting as steps of a ladder. The bottommost end of the escape device connects to the top of the next lower escape device to create a continuous escape system allowing egress from any floor to the ground.

16 Claims, 2 Drawing Sheets

WINDOW SHUTTER ESCAPE LADDER

FIELD OF THE INVENTION

The present invention relates to emergency escape devices, and more specifically to emergency escape devices which resemble window shutters.

BACKGROUND OF THE INVENTION

In prior art, numerous types of escape ladders are described allowing escape from the upper floors of a building when the normal escape routes are not accessible.

These ladders must be available when needed, made to easily convert from their storage arrangement into their operational position allowing escape means leading from one of the upper floors to the ground.

Security

For security purposes, the escape ladders must allow exit during an emergency, however, these must not allow access into the building when in their storage position. This would be a breach of security.

Therefore they are typically stored in a non-useable arrangement, but are allowed to be converted into a useable arrangement when needed.

These escape devices fall into the categories of rope ladders, telescoping ladders, unfolding ladders stored in a location near a door or window. There are also ladders that are bolted to the walls which have an extendable lower section that may be rope, unfolding or telescoping type ladders.

These ladders typically are stored in boxes or containers on an upper floor, then thrown down, or extended to the ground when needed.

Storage Locations

Due to their required size, escape ladders on higher floors are larger and require more storage space. These require a large box, which may become bulky and block the door or window, and not be aesthetically pleasing.

Must Be Always Available

In order to allow better access to a window or door, people may tamper with, or remove the escape device. This may render the device unusable. An unusable escape device does the residents no good.

Aesthetics

Other prior art designs have placed escape devices in a window sill, above the window in an enlarged frame, or tucked underneath on a platform that has been added to the building. These tend not to be very aesthetically pleasing.

These may be removed, tampered with, or altered to make them more aesthetically pleasing, and inadvertently disable them. This again results in a system that is not ready for use in an emergency situation.

There have been some attempts to design the tamper-resistant escape devices. One such device has the ladder folded into a single strip which attaches to the building wall. It looks like decoration of the building in its storage position, and also has the ability to be locked in its storage position with a lock. This will keep the building secure and will prevent tampering; however, if there is an emergency, and the residents do not have access to the key, or combination for the lock, the results may be disastrous.

Blend Into Scenery

An attempt was made to devise such an escape ladder which uses a wall decoration that has slats that pivot into a ladder. This is attached to a wall at ground level, is one section long with no means of being extended. The escape device is intended to blend into the scenery and is less likely to be a target of tampering.

However, it is intended to be placed low to the ground allowing access to the house in its storage position. This would be a breach of security. It also does not extend far enough to be of use in multi-story buildings.

Redundancy

Many of the prior art escape devices are designed without consideration to use on multiple floor buildings. These are typically designed to extend from their storage location, continuously to the ground. Take, for example, a rope ladder stored in a box on the third floor of a 7 floor building. For this to be useful, it must extend from the third floor to the ground. The same is true for on $2^{nd}$, $4^{th}$, $5^{th}$, $6^{th}$, and $7^{th}$ floors. Therefore, when all are in use, there will be 6 ladders between the $1^{st}$ and 2nd floors, 5 between the $2^{nd}$ and the $3^{rd}$ floors, 4 between the $3^{rd}$ and $4^{th}$ floors, etc. This redundancy leads to larger escape devices that partially block windows and doors, and are not aesthetically pleasing.

Currently there is a need for an escape ladder that does not allow access when not in use, is always available, does not take up excess of space in the building, is aesthetically pleasing, and is readily available for use.

SUMMARY OF THE INVENTION

In accordance with the present invention, a novel escape device for multi-story buildings is disclosed. The device is designed to look like window shutters, and intended to blend in and look like part of the building. Since it blends in with the decor of the building, 1) the presence of the escape ladder is not readily apparent, thereby reducing the chances that it may be used for unauthorized access into the building, and 2) since the escape ladder is compact and inconspicuous, there is less chance that it would be modified or overridden, allowing it to be readily available for use a larger percentage of the time than other escape devices.

The device is constructed of a frame having two vertical hollow side rails and horizontal top and bottom sections. The horizontal bottom section is designed to open and close the bottom of the hollow side rails when activated by a release mechanism.

A ladder is comprised of horizontal reinforced slats used for steps and vertical connecting means between each of slats is stored in its collapsed storage position. In its storage position, the slats are in an angled position relative to the frame, a fixed small distance from each other, resembling a shutter.

The vertical connecting means is designed to be collapsible such that the slats may be stored in close proximity to each other, but extend a short distance (approximately the height of an average step) from each other when in the active position.

The frame may be fixed to the building wall, or attached by strong hinges adjacent a window or door. If hinged, when in use, the frame may be hinged outward, allowing easier access from a window. A locking support structure may be used to keep the ladder from swinging back into its stored position.

This may be employed as a single floor escape device, or several of such devices may be employed vertically above each other on higher floors of a multi-floor building. Each allows access to the next floor below, thereby allowing access from any floor to the ground without redundant equipment.

In this embodiment, each may be made to attach to the top of the escape device on the next floor below to make one continuous structure extending to the ground.

OBJECTS OF THE INVENTION

Accordingly, an object of the present invention is to provide a novel escape ladder that resembles a window shutter of a building.

Another object of the present invention is to provide a novel escape ladder that is always available for use.

Another object of the present invention is to provide a novel escape ladder that does not allow access into the building from outside, but does allow an emergency exit from within the building.

Another object of the present invention is to provide a novel escape ladder which does not interfere with the normal use of the windows, or doors.

Another object of the present invention is to provide a novel escape ladder which does not take up space within the building.

Another object of the present invention is to provide a novel escape ladder which is segmented into sections for each floor, where is practical for use in a multi-floor building.

Another object of the present invention is to provide a novel escape ladder which is aesthetically pleasing.

BRIEF DESCRIPTION OF THE DRAWINGS

A complete understanding of the present invention may be obtained by reference to the accompanying drawings, when considered in conjunction with the subsequent detailed description, in which.

For purposes of brevity and clarity, like components and elements of the apparatus of this invention will bear the same designations or numbering throughout the figures.

DESCRIPTION OF THE PREFERRED EMBODIMENT

This invention relates generally to the field of emergency escape ladders. It is best implemented as a structure resembling a window shutter, attached to a building near a window or door.

Figure 1:
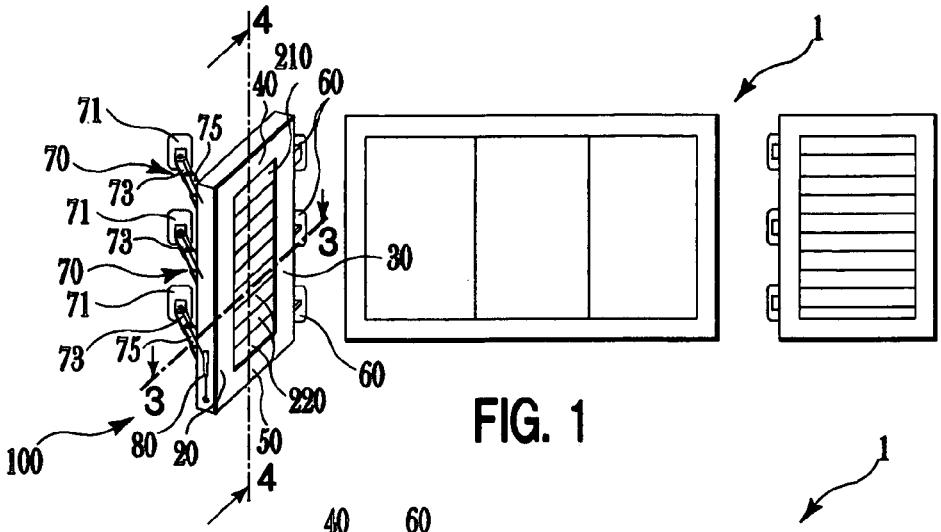
FIG. 1 is a perspective view of an escape device according to the present invention in its non-operational, storage position.

In accordance with the present invention, a novel escape device for multi-story buildings is disclosed. The device is designed to blend in, and look like a part of the building. This serves two functions, 1) the presence of the escape ladder is not readily apparent, thereby reducing the chances that it may be used for unauthorized access into the building, and 2) since the escape ladder is compact and inconspicuous, there is less chance that it would be modified or overridden, allowing it to be readily available for use a larger percentage of the time than other escape means. As shown in FIG. 1, the present invention 1 is shown in its storage position.

Escape device 1 is constructed of a frame 100 having two vertical hollow side rails 20, 30, a horizontal top section 40 and a horizontal bottom section 50. Horizontal bottom section 50 is detachable from side rails 20, 30 and is designed to be open and close the bottom of the hollow side rails 20, 30.

When the escape device 1 is in its storage position as shown in FIG. 1, the vertical connecting means 230, 240 collapse such that the slats 210, 220 may be storage in close proximity to each other, resembling slats in typical window shutters.

Preferably in its storage position, each of the slats 210 220 are parallel to each other in an angled position, a fixed small distance from each other.

When an emergency arises, a user activates the device by pulling a lever 80 or similar prior art device to place device 1 into its operational position. This releases the bottom section 50 allowing an expandable ladder 200 to be released from the device 1. By actuating lever 80, the ladder is released and allowed to swing away from the building wall.

Figure 2:
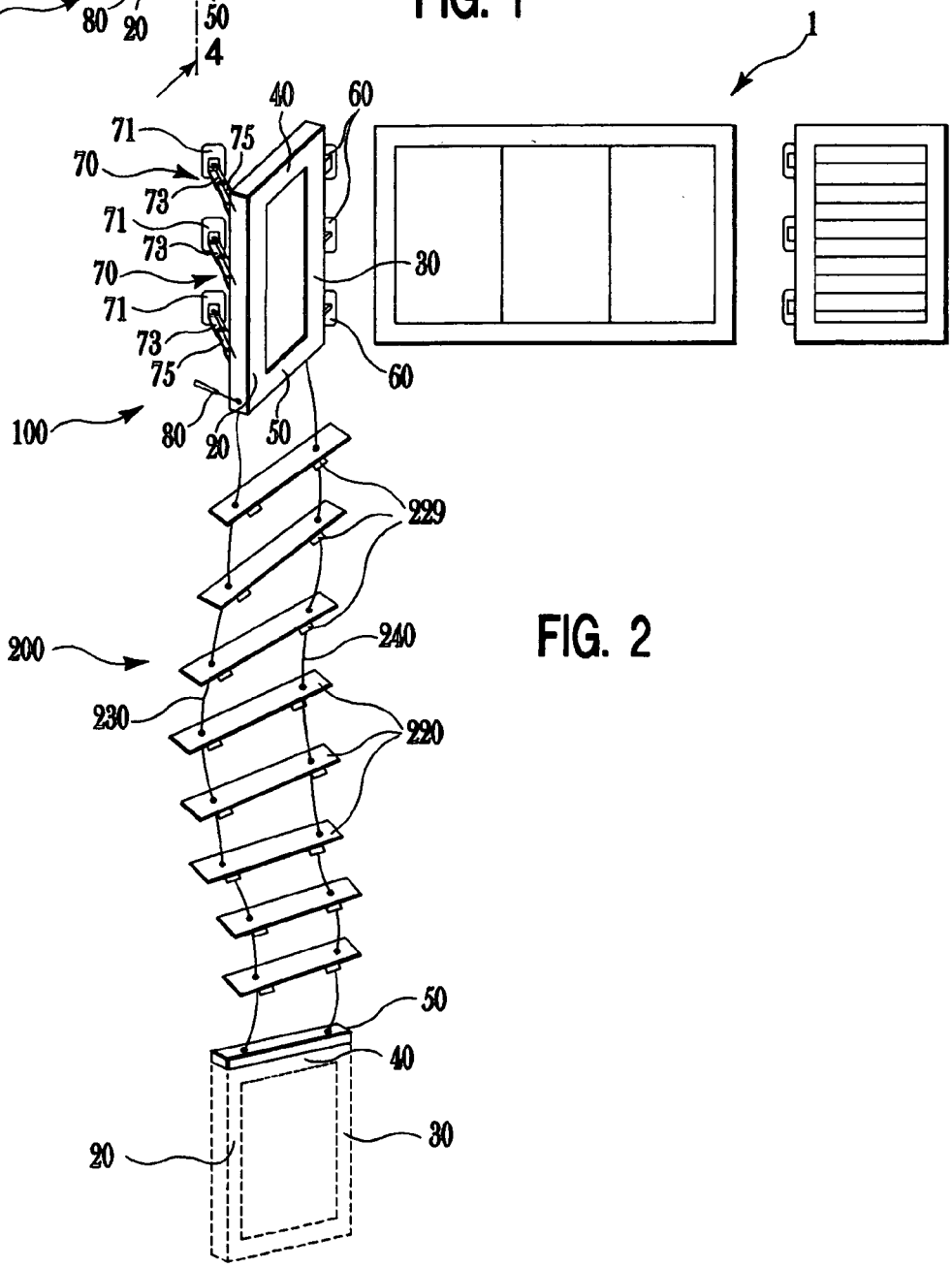
FIG. 2 is a perspective view of the escape device of FIG. 1 in its operational position, extending down to the next floor.

As shown in FIG. 2, expandable ladder 200 contained within frame 100 is shown in its operational position. Expandable ladder 200 is comprised of a horizontal reinforced top slat 210, a plurality of horizontal reinforced middle slats 220. Each of the slats 210, 220 should be constructed with ribs or supports to hold a considerable amount of force.

The slats are held a predetermined distance apart from each other vertically by at least one collapsible vertical connecting means 230, 240. Vertical collapsing means 230, 240 is shown here as a cable, cord, or rope, however, it may also be implemented as a folding, telescoping or other structure capable of collapsing in the storage position, and extending to a fixed length in the operational position. In an alternate embodiment, top slat 210 is allowed to extend downward a larger distance using more slack of collapsing means 230, 240 between top slat 220 and horizontal top section 40 than slats 220. This allows top slat 210 to be at a level lower than the window frame 100. This allows the expandable ladder 200 to extend downward a greater distance than if slat 210 started at the top section 40 of window frame 100.

Frame 100 may be fixed to the building wall near a window or door by attachment points 60 as shown in FIG. 1. Alternatively, escape device 1 may be attached to the building wall with several strong hinges 60 of FIG. 2 adjacent a window or door. When in use frame 100 and ladder 200 may be hinged outward, allowing easier access from a window. A set of braces 70 may be used which extend from the building wall to side rail 20 to hold ladder from swinging on its hinges. One such embodiment employs a telescoping section with one section inside of another. The telescoping section may locked into place with a spring loaded ball on an inside section biased against the outer section, and a recess in the outer section which receives the ball when the telescoping sections are extended.

Figure 3:
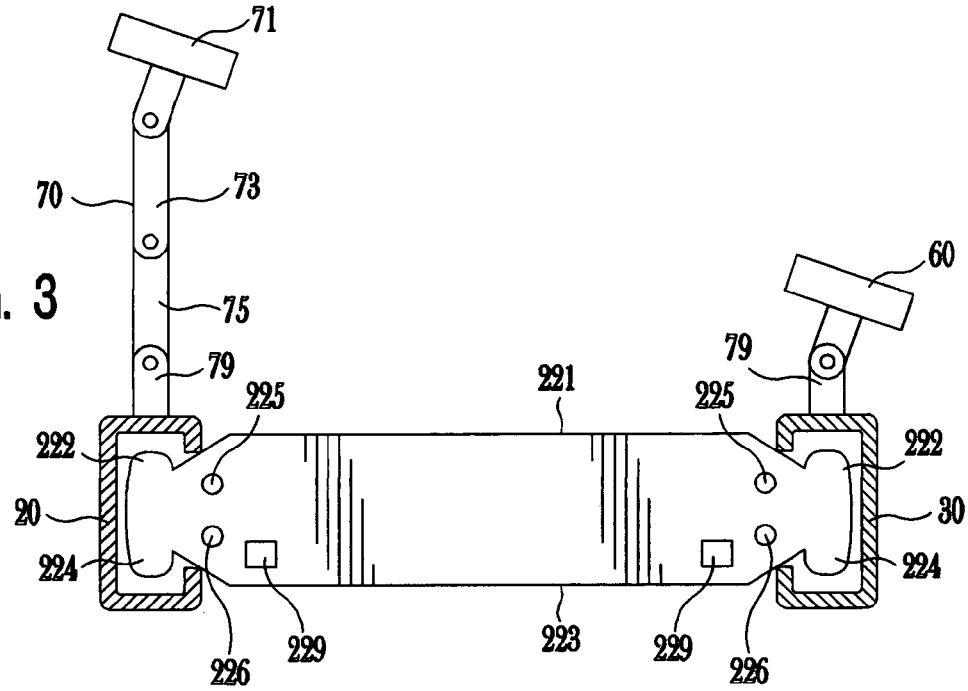
FIG. 3 is an enlarged perspective view of a middle slat of the present invention.

Another embodiment, as shown in FIG. 3 shows a simple hinged arm 70. It has a wall member 71 attached to the building wall, a rail member 79 attached to side rail 20, and two intermediate folding members 75, 79 connecting the wall 71 and the side rail 79 members. Again these may be locked into place using a spring loaded ball biased against one of the adjacent members. A recess is located the adjacent brace member to receive the ball, locking the brace 70 in its position. All of the locking components may also be unlocked without the use of tools.

FIG. 3 shows a cutaway plan view of escape device 1 viewed along lines 3—3 of FIG. 1. FIG. 3 shows inner edge 221 and outer edge 223 of slat 220. This is also the same for slat 210. A protrusion 222 of the inner edge 221 is made to be held in and slide along side rails 20, 30. Similarly, protrusions 224 are also designed to be held in and slide along side rails 20, 30. They are sized such that they may be parallel to the ground in the operational position (as shown here) but will also be retained by side rails 20, 30 when they are in their angled storage position, as shown in FIG. 4.

The slats 210, 220 are preferably slanted with an inward edge 221 of each slat 210, 220 is angled higher and closer to the building, than an outward edge 223. Outward edge 223 of each slat 210, 220 is lower and further from the building. Outward edge 223 slightly overlaps the inner edge 221 of each next lower slat giving a louvered appearance.

Vertical connecting means 220, 230 connects to each of the slats at connection points 225 of FIG. 3. Also visible as dotted lines, are the spacer blocks 229. These are used to hold the slats 21, 220 a fixed distance apart when in the stored position. They are preferred on the inner and outer edges 221, 223 of each slat, to have them store parallel to each other, but may be only used on the outer edge 223 to space the portion which is visible. Other known means may also be used to space these slats.

Figure 4:
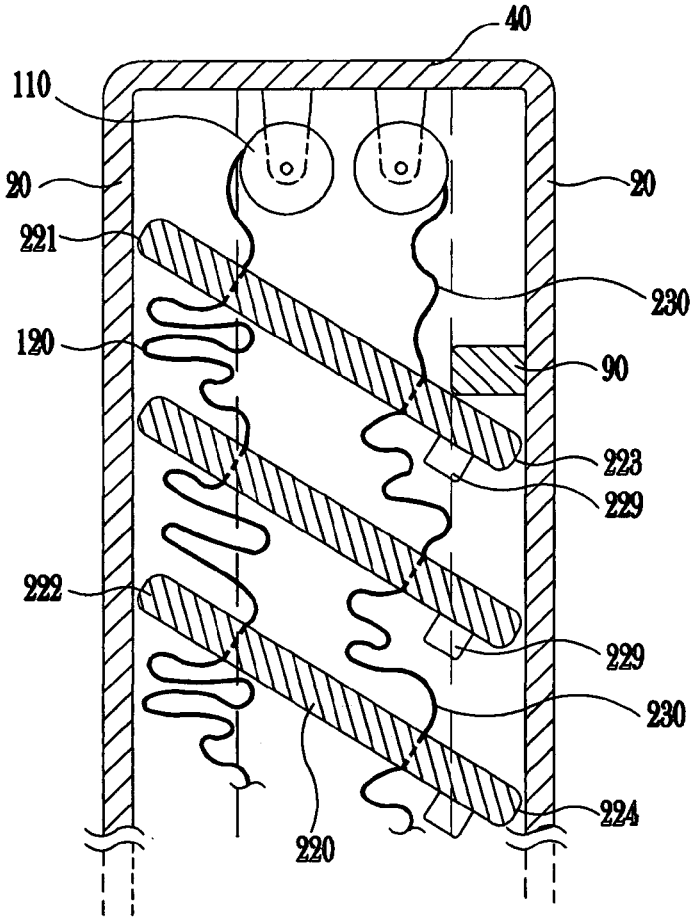
FIG. 4 is partial cut away side view of the present invention in its storage position.

In FIG. 4, a retraction means 120, which may be a cable or cord, may be used that is made to slide through each of the slats and connect to the bottom slat (or bottom member). Retraction means 120 pulls all of the slats up into the frame where a user guides each of the protrusions 222, 224 into rails 20, 30 to put the expandable ladder 200 back into its storage position. As the top slat 210 is being retracted back up the side rails 20, 30, a stop block 90 mounted at the top of side rails 20, 30 stops the progress of protrusion 224 and the outer edge 223 of the slats. As the top slat 210 is pulled up into side rails 20, 30 and meets stop block 90, it tilts as shown in FIG. 4.

Retraction may optionally be performed by a pulley means 110. The pulley means may be a manual crank, a manual pulley device, or an electric powered pulley system.

Escape device 1 may be employed to escape down a single floor, as from a second floor to the ground as discussed up to this point. In an alternate embodiment, escape device 1 may be deployed as several of the units shown in FIGS. 1–4 vertically above each other on higher floors of a multi-floor building. In FIG. 2, as shown in phantom, bottom section 50 of an escape device 1*a* from a higher floor extends down to a horizontal top section 40 of an escape device on a next lower floor.

Bottom section 50 is then allowed to attach to top section 40 by use of prior art technology, such as hooks, clamps, snaps, etc. to hold these two portions together. Therefore the bottom of each escape device is attached to the top of escape device of the next floor below, thereby making a complete escape device from any given floor to the ground below without the need for redundant equipment.

Escape device 1 should be constructed taking into account the fact that several large people may be rapidly climbing down the ladder at the same time. Since impact forces are significantly higher than a steady state weight, the structures must be designed to handle these impact forces. The resulting device must then also include additional safety margin above the calculated strength.

Having thus described the invention, what is desired to be protected by Letters Patent is presented in the subsequently appended claims.

What is claimed is:

1. An escape device allowing emergency escape from a building, designed to resemble a window stutter capable of being in a stored arrangement, or in an operational arrangement, the escape device comprising:

a) a frame, adapted to be adapted to be attached to said building, wherein the frame comprises two side rails b) a collapsible vertical connecting means anchored to the frame, c) a plurality of slats received by and slide along the side rails, the slats also being connected to the vertical connecting means at predetermined locations along its length, wherein i. the slats may be placed into, and slide along the two side rails of the frame, and be positioned in the stored arrangement stacked on top of each other in an angled position relative to the frame, resembling a window shutter, and ii. the vertical connecting means may be extended in the operational arrangement allowing the slats to extend down the frame and out the bottom, with each slat being spaced from adjacent slats approximately the distance of steps on a conventional ladder, the slats and vertical connecting means functioning as an escape ladder.

2. The escape device of claim 1 wherein the frame is adapted to be attached flat against a wall of the building adjacent a window.

3. The escape device of claim 1 wherein the frame is adapted to be attached to the wall of the building adjacent a window with at least one hinge.

4. The escape device of claim 1 wherein the slats each have protrusions on an inner and outer edge at its ends, wherein the protrusions are sized to fit in, and slide up the side rails.

5. The escape device of claim 1 wherein each slat has an outer edge and a plurality of spacers are located on the outer edges of the slats to function to separate the slats and give them the appearance of louvers of a window shutter.

6. The escape device of claim 1 wherein there is an obstruction within at least one of the side rails near the top, on a side of the outer side of the slat functioning to tilt the slats as they are placed in their storage position.

7. The escape device of claim 1 wherein the frame further comprised a bottom slat that is connected to the bottom of the vertical connecting means and is designed to connect to, and close the side rails in the storage position, holding the slats in the frame, and is allowed to separate from the frame in the operational position opening the side rails allowing the slats to extend downward and out of the frame and thereby function as a bottom step.

8. The escape device of claim 1 further comprising a retraction means connected to the bottom slat, functioning to pull up and retract the slats into the frame to put them in their storage position.

9. An escape system allowing emergency escape from a multi-floor building, having a plurality of escape devices mounted on each floor substantially vertically above a next lower floor having a next lower escape device, each designed to resemble a window shutter, and each capable of being in a stored position, or in an operational position, each escape device comprising:

a. a frame, adapted to be attached to said building, having a horizontal top member and a horizontal bottom member, b. a collapsible vertical connecting means anchored to the frame at a top end and to the bottom member at a bottom end, c. a plurality of slats connected to the vertical connecting means at predetermined locations along its length, wherein i. the slats may be placed into the frame in the storage position stacked on top of each other in an angled position relative to the frame, resembling a window shutter, and ii. the vertical connecting means may be extended in the operational position allowing the slats to extend down the frame and out the bottom, with each slat being spaced from adjacent slats approximately the distance of steps on a conventional ladder, the bottom member of each escape device being capable of attaching to a top member of the next lower escape device to create a continuous escape system from any floor to the ground.

10. The escape device of claim 9 wherein at least one frame is attached flat against a wall of the building adjacent a window.

11. The escape device of claim 9 wherein at least one frame is attached to the wall of the building adjacent a window with at least one hinge.

12. The escape device of claim 9 wherein at least one frame is comprised of two side rails designed to receive the slats and allow them to slide into the frame.

13. The escape device of claim 9 wherein the slats each have protrusions on an inner and outer edge at its ends, wherein the protrusions are sized to fit in, and slide up the side rails.

14. The escape device of claim 9 wherein there are spacers on the outer edges of the slats to function to separate the slats and give them the appearance of louvers of a window shutter.

15. The escape device of claim 9 wherein there is an obstruction within at least one of the side rails near the top, on a side of the outer side of the slat functioning to tilt the slats as they are placed in their storage position.

16. The escape device of claim 9 further comprising a retraction means connected to the bottom member, functioning to pull up and retract the slats into the frame to put them in their storage position.

* * * * *